US008225870B1

(12) United States Patent
Pietrobelli et al.

(10) Patent No.: US 8,225,870 B1
(45) Date of Patent: Jul. 24, 2012

(54) METHOD FOR MAKING WINDOWS IN OIL WELL CASINGS

(75) Inventors: Alejandro Pietrobelli, Edo Zulia (VE); Fausto Pietrobelli, Edo Zulia (VE)

(73) Assignee: Mecol Holding, LLC, Miami, FL (US)

( * ) Notice: Subject to any disclaimer, the term of this patent is extended or adjusted under 35 U.S.C. 154(b) by 0 days.

(21) Appl. No.: 13/024,036

(22) Filed: Feb. 9, 2011

Related U.S. Application Data

(63) Continuation-in-part of application No. 12/508,088, filed on Jul. 23, 2009, now abandoned.

(51) Int. Cl.
*E21B 43/04* (2006.01)

(52) U.S. Cl. ..... 166/278; 166/51; 166/179; 166/227; 175/53

(58) Field of Classification Search ..... 166/267, 166/278, 51, 280, 315, 179, 227; 175/53, 175/57, 263, 267, 406
See application file for complete search history.

(56) References Cited

U.S. PATENT DOCUMENTS 3,850,246 A 11/1974 Despujols ..... 166/278
5,597,040 A * 1/1997 Stout et al. ..... 166/51
6,189,616 B1 * 2/2001 Gano et al. ..... 166/298

* cited by examiner

*Primary Examiner* — William P Neuder
*Assistant Examiner* — Yong-Suk Ro
(74) *Attorney, Agent, or Firm* — Sanchelima & Associates, P.A.

(57) ABSTRACT

A method for making gravel filters in oil well bores. The first step involves ascertaining the location of a producing formation adjacent to a cemented casing in a well bore. Then, a portion of the casing adjacent to the producing formation is cut, enlarging the bore adjacent to the producing formation. Subsequently, a sufficient amount of gravel is deposited in the enlarged portion of the bore to create an effective filter for a producing tube with a screen at its distal end. The distal end is positioned adjacent to the cemented bottom of the well bore. The method maximizes the diameter of the gravel deposited by delivering it exteriorly of the screen of the producing tube and through the annular space defined and sealed between the screen and the casing.

5 Claims, 9 Drawing Sheets

METHOD FOR MAKING WINDOWS IN OIL WELL CASINGS

OTHER RELATED APPLICATIONS

The present application is a continuation-in-part of pending U.S. patent application Ser. No. 12/508,088, filed on Jul. 23, 2009, which is hereby incorporated by reference.

BACKGROUND OF THE INVENTION

1. Field of the Invention

The present invention relates to a method for making gravel filters in oil well bores, particularly in those oil well bores where there are water veins near oil producing formations.

2. Description of the Related Art

Some producing formations tapped by oil well installations have sandy characteristics that require the creation of gravel filters adjacent to the producing formation. The present methods typically gun the casing to make holes that connect the producing tube with a gravel filter that is defined by the inner surface of the well bore and the outer surface of the casing. This results in a very limited and thin gravel filter that is susceptible to getting clogged thereby frequently interrupting the operation of the well. The method is also not very precise.

Several methods for making gravel filters in oil well bores have been used in the past. None of them, however, have the flexibility and precision, nor the effectiveness (from its larger size), of the present method. Additionally, this method can be used in new and old oil wells, including those where the gun method was used. The precision characteristics of the present method are quite desirable in oil wells with water veins in relative proximity to the oil producing formation.

Applicant believes that the closest reference corresponds to U.S. Pat. No. 3,850,246 issued to Despujols for a gravel packing method and apparatus.

However, it differs from the present invention because the gravel is delivered through and out of the screen, necessitating additional sealing members 48, 50, and 52. Also, the diameter size of the gravel is severely limited by the constraints of the passages through which the gravel is passed.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a method for making windows in oil wells that permits a user to use gravel of different diameters.

It is another object of this invention to provide such a method with minimum obstruction to the passage of gravel.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
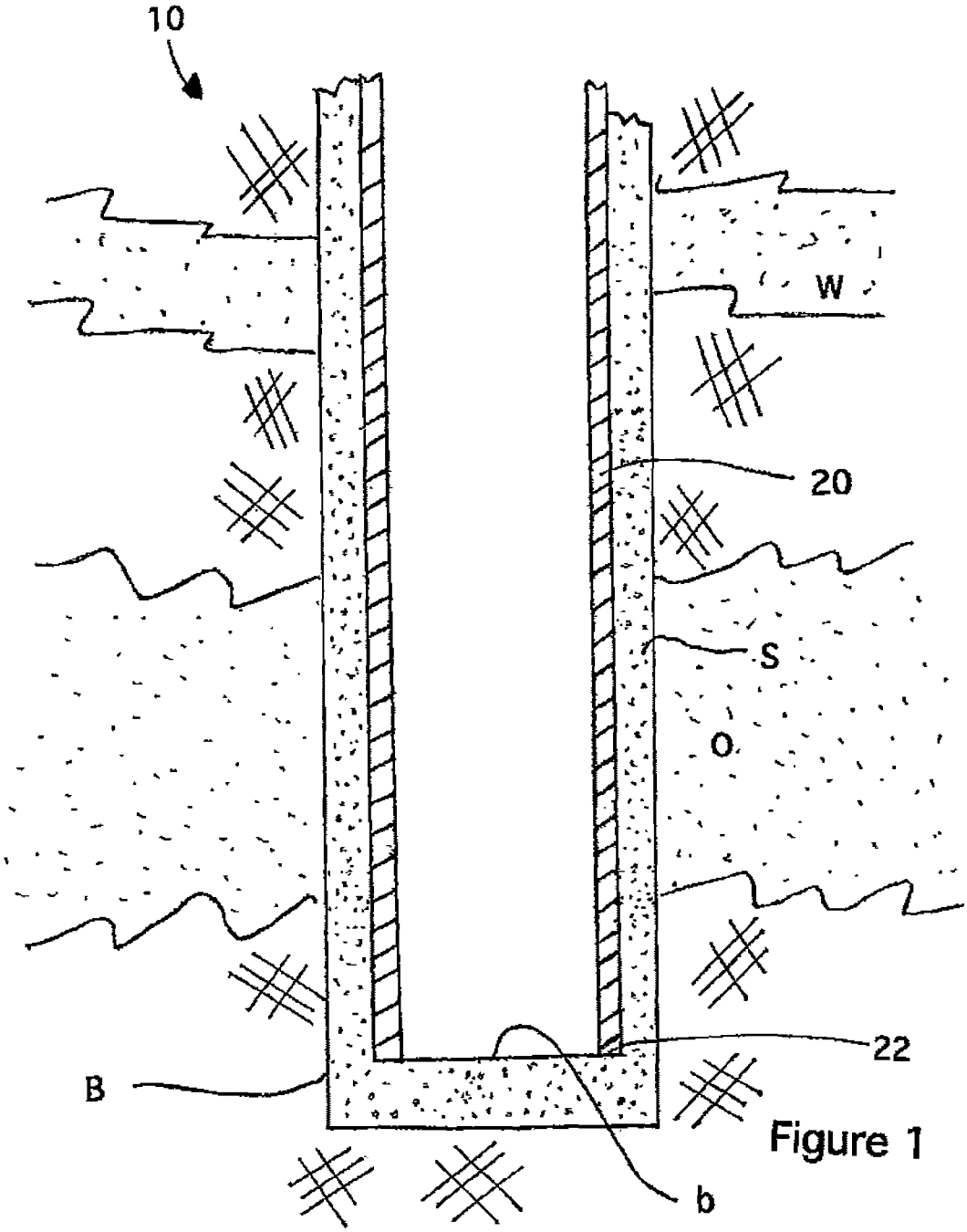
FIG. 1 represents an elevational cross-sectional view of an oil well bore B with a new (unused) casing 20 and a cemented bottom. A producing formation and a water vein above it are also represented to show typical characteristics in an oil well.
Figure 2:
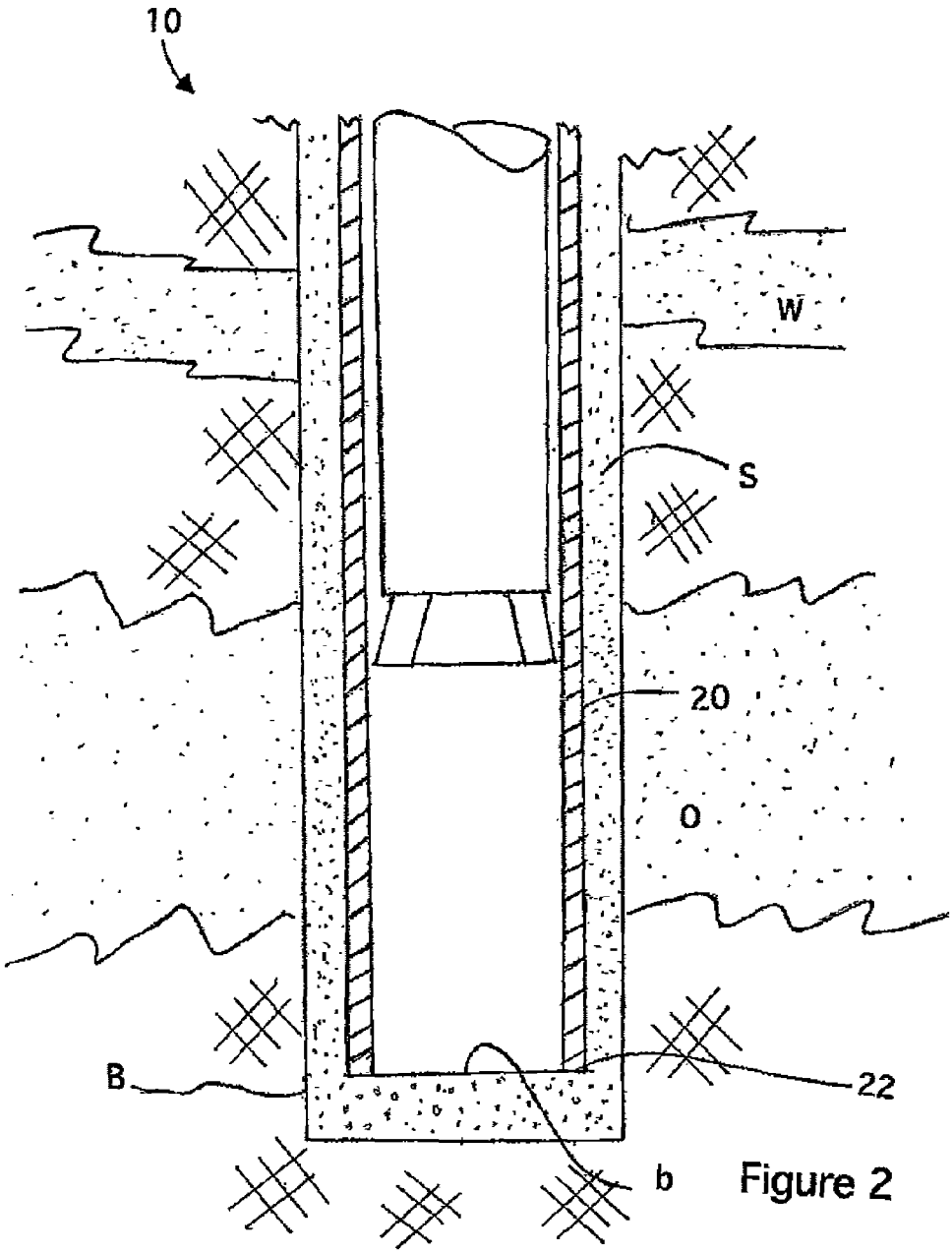
FIG. 2 shows an elevational representation similar to the one shown in the previous figure with a section mill tool positioned to start cutting through the casing.
Figure 3:
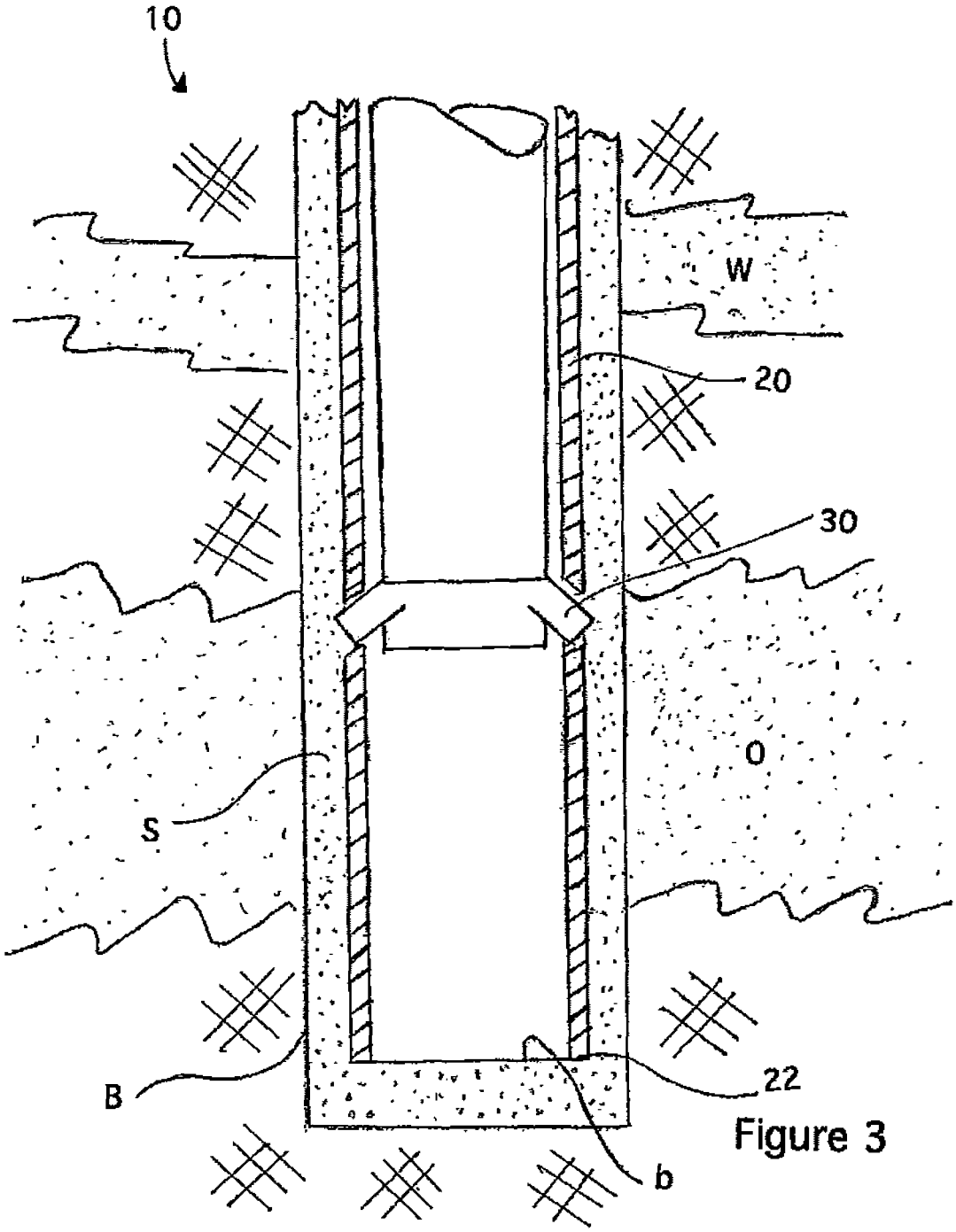
FIG. 3 illustrates another elevational view similar to the previous figures with the blades cutting through the casing.
Figure 4:
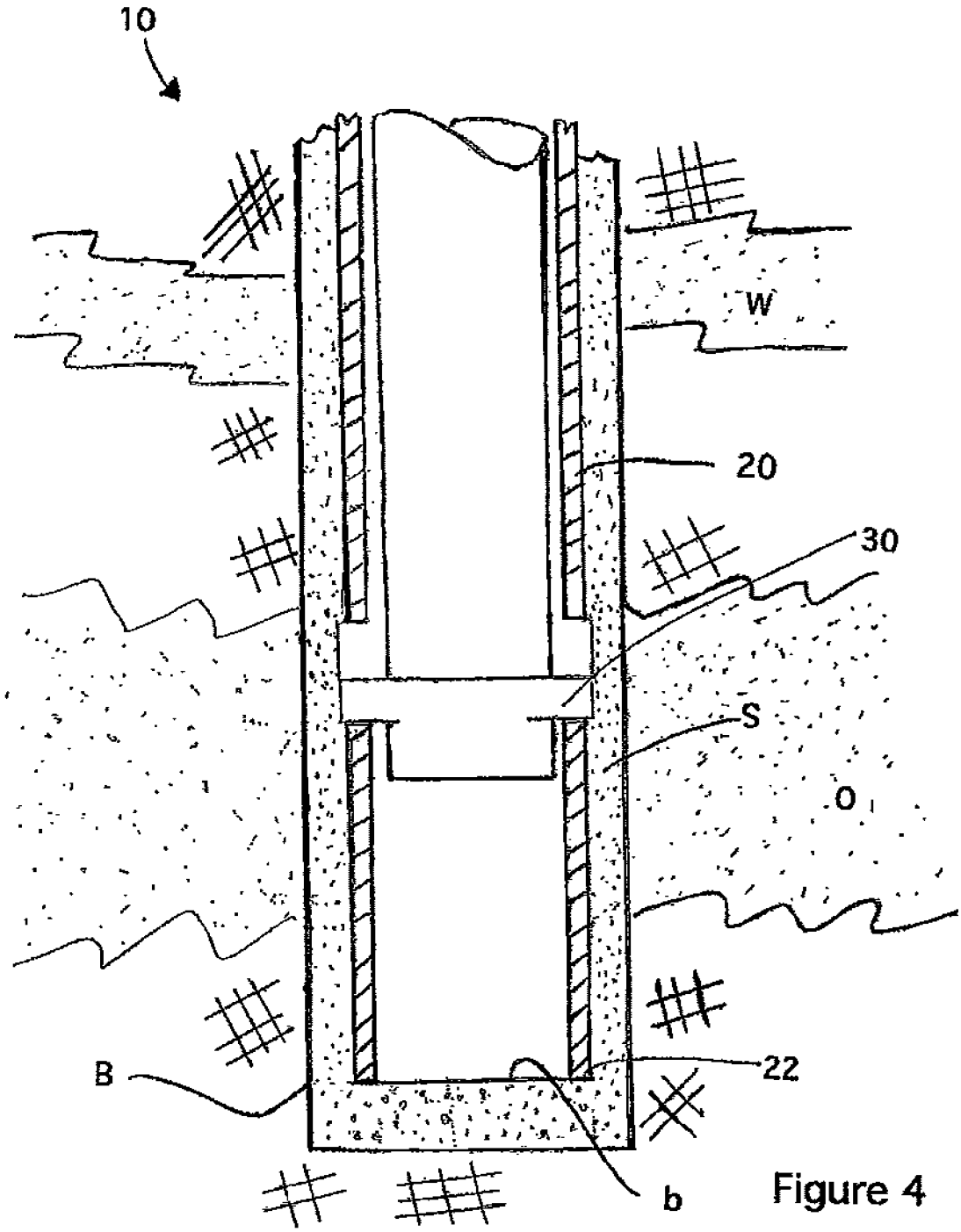
FIG. 4 is a representation of an elevational view of the well's bore with the tool section milling the casing.

Referring now to the drawings, where the present invention is generally referred to with numeral 10, it can be observed that it basically includes casing 20 that extends coaxially inside bore B that includes a cemented bottom b, as it is typically found in new oil well installations. Bore B typically passes through water formations W and oil producing formations O. The space S between casing 20 and bore B is typically cemented to keep casing 20 in place. The lowermost end 22 of casing 20 is typically brought against bottom b. Several tools are then inserted in casing 20 and lowered to the required locations and finally the producing casing is installed.

Figure 8:
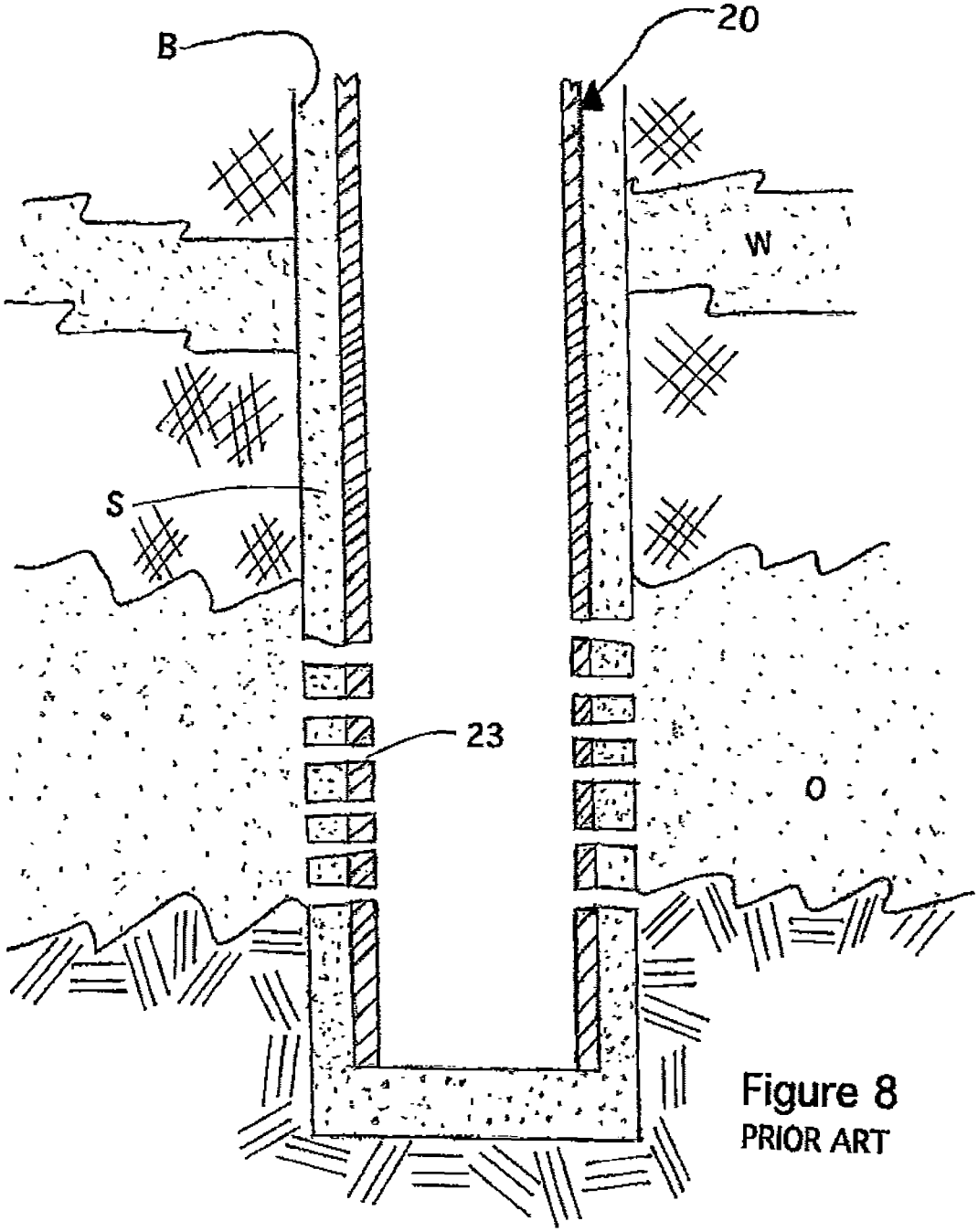
Figure 8 PRIOR ART
FIG. 8 shows an elevational view of a conventional oil well as it exists in the prior art.

In old oil well installations, a filter has been previously made with a gun perforator that caused holes 23 to be made through casing 20 at predetermined locations, as shown in FIG. 8. The explosives used penetrate through cemented space S. The present invention can also be used to repair these conventional operating oil well installations.

The first step in the present method is to ascertain the location where the window for the filter is to be made or where the repair is to take place. Once this is determined, a section milling tool is lowered to that location and casing 20 is cut, creating an interruption. The cutting takes place with precision that is not possible with the gunning method. In this manner, a user can avoid water formations W. Casing 20 is kept in place since the annular space between casing 20 and the surface of bore B has been cemented, as it is conventionally done in the industry. A section milling tool, like the one described in U.S. Pat. No. 6,920,923, can be used to perform this function. A section milling tool is used to cut casing 20 and concentrates its blades' action on this operation.

Figure 5:
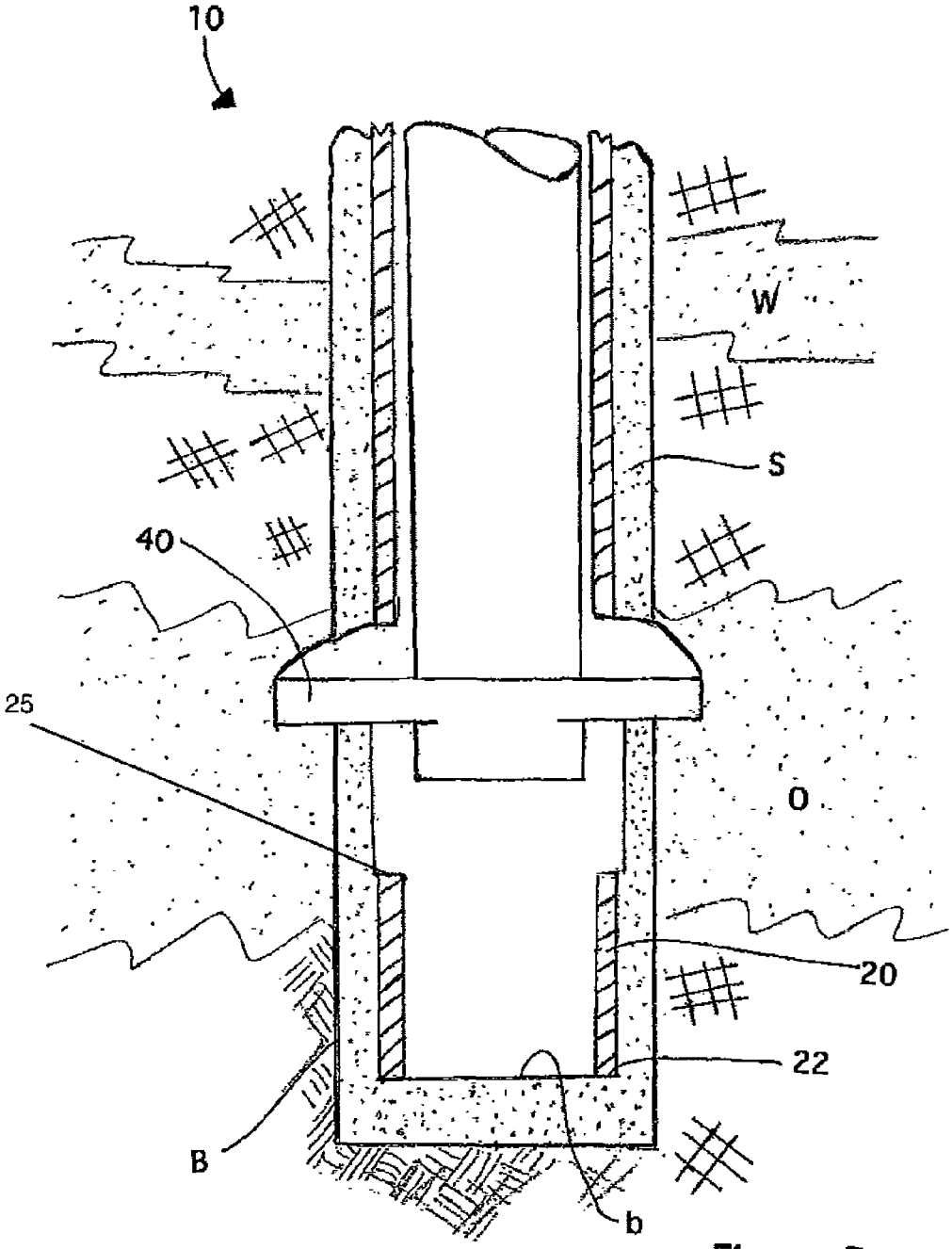
FIG. 5 shows a cross-sectional view of the well's bore except for the underreamer tool for which the cross-section is not shown. The underreamer is shown enlarging the bore in a predetermined location.

The next step, after withdrawing the section milling tool 30, is the lowering of the underreamer 40 to the location where the window was formed. An underreamer, like the one described in Applicant's U.S. Pat. No. 5,896,940, can be used for this step. The underreamer enlarges the diameter of the bore at a location adjacent to where window 25 was formed as it can be seen in FIG. 5.

Figure 6:
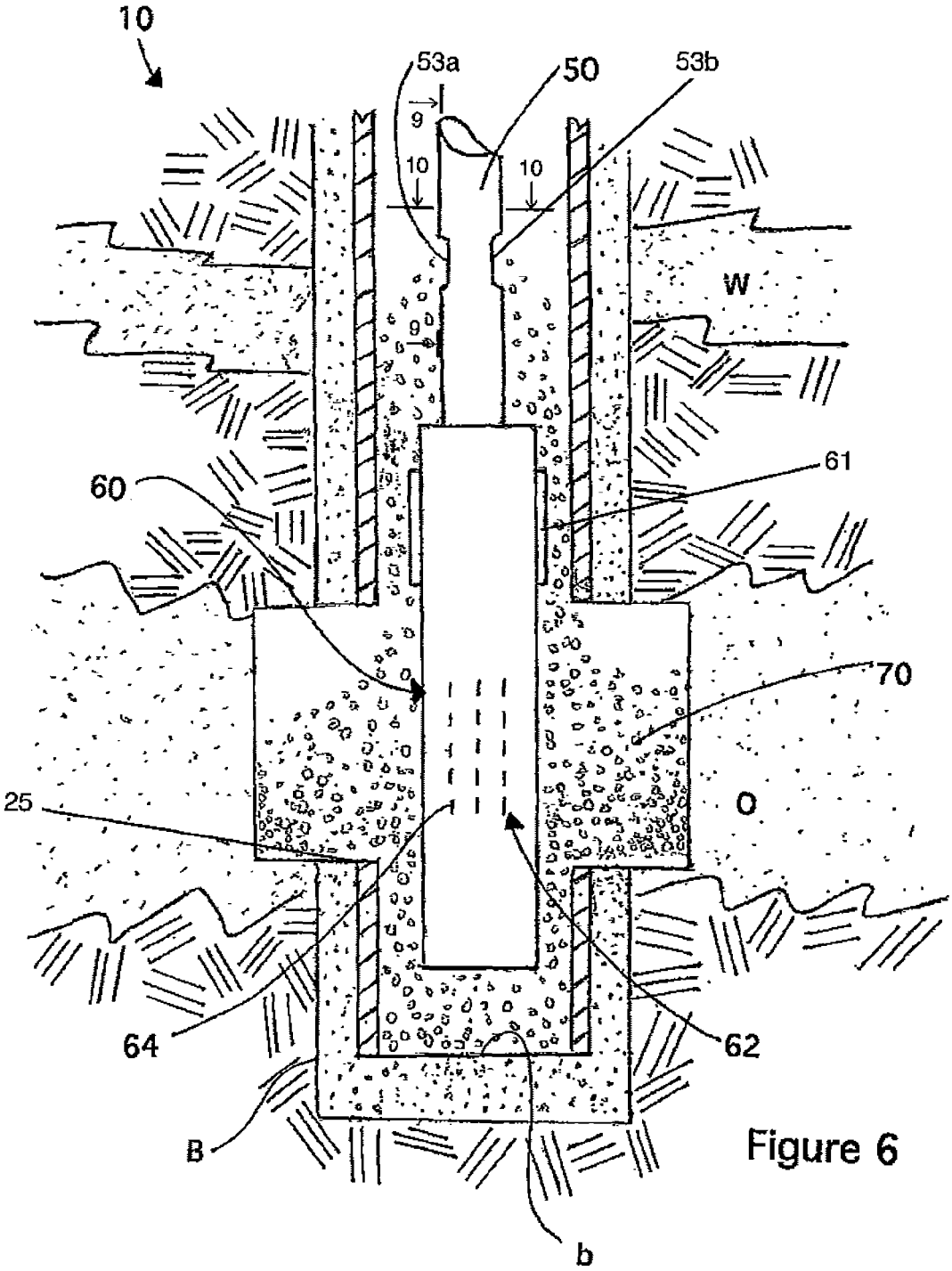
FIG. 6 shows an elevational view of the well's bore with a tool forming a gravel-packed filter between the enlarged portion of the bore and the casing.
Figure 9:
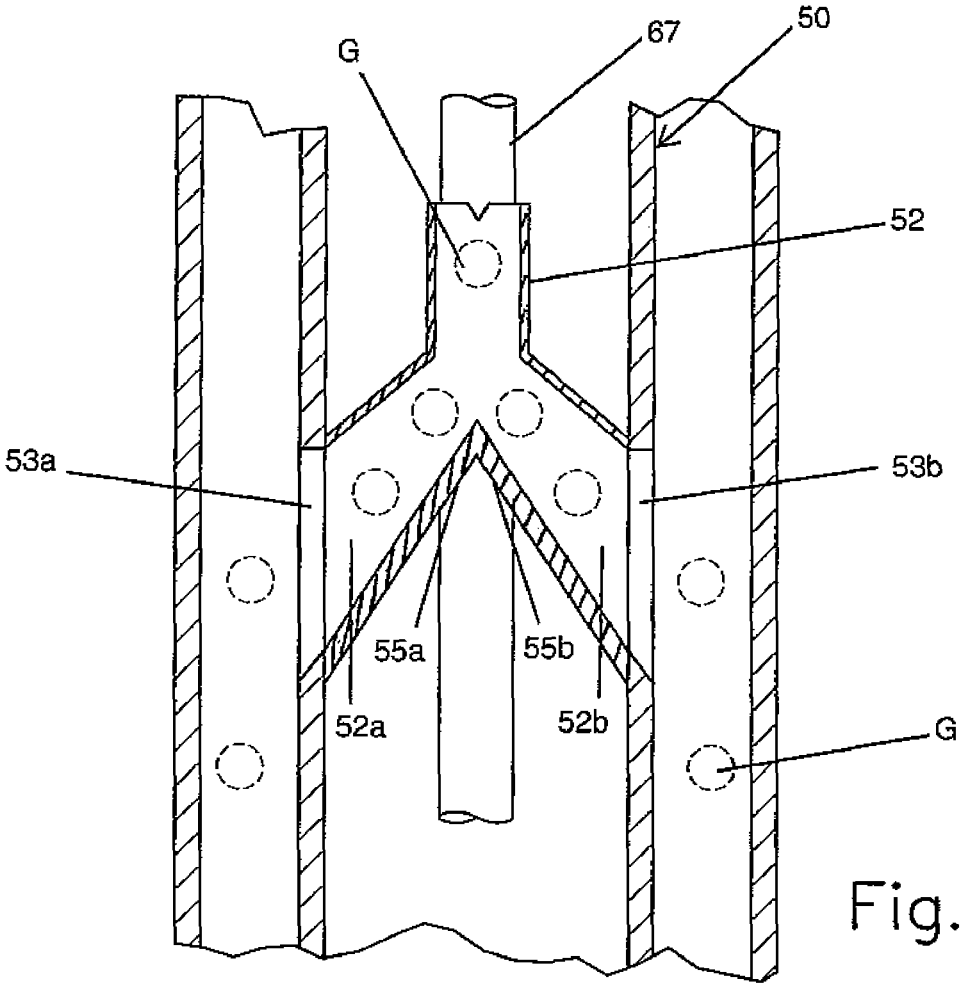
FIG. 9 is a partial cross-sectional representation of setting tool 50 taken along line 9-9 in FIG. 6.
Figure 10:
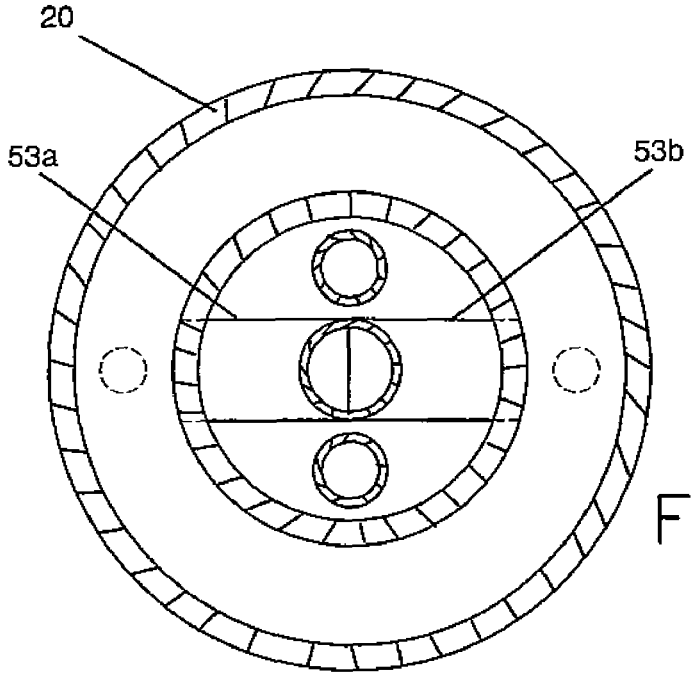
FIG. 10 is a cross-sectional view of setting tool 50 taken along line 10-10 in FIG. 6.

After retrieving underreamer 40, a setting tool 50 is lowered and a mix of gravel and a fluid is pumped radially through openings 53*a* and 53*b*, as seen in FIG. 6. The fluid can be water or other suitable liquid conventionally used to carry granular material, such as gravel, in oil well installations. Gravel G and fluid (not shown) are delivered downwardly through tube 52, as best seen in FIG. 9. Tube 52 is bifurcated, in the embodiment shown in FIGS. 9 through 10, with inclined tubes 52*a* and 52*b* extending radially outwardly with respective openings 53*a* and 53*b*. Openings 53*a* and 53*b* are positioned in setting tool 50 above screen 62 when the former is operationally engaged to producing tube 60. The lower surfaces 55*a* and 55*b* are reinforced with thicker walls to withstand the abrasive action of the gravel and fluid. Sealing units 61 are not deployed when gravel G is delivered from above screen 62 and passes between screen 62 and casing 20.

Figure 7:
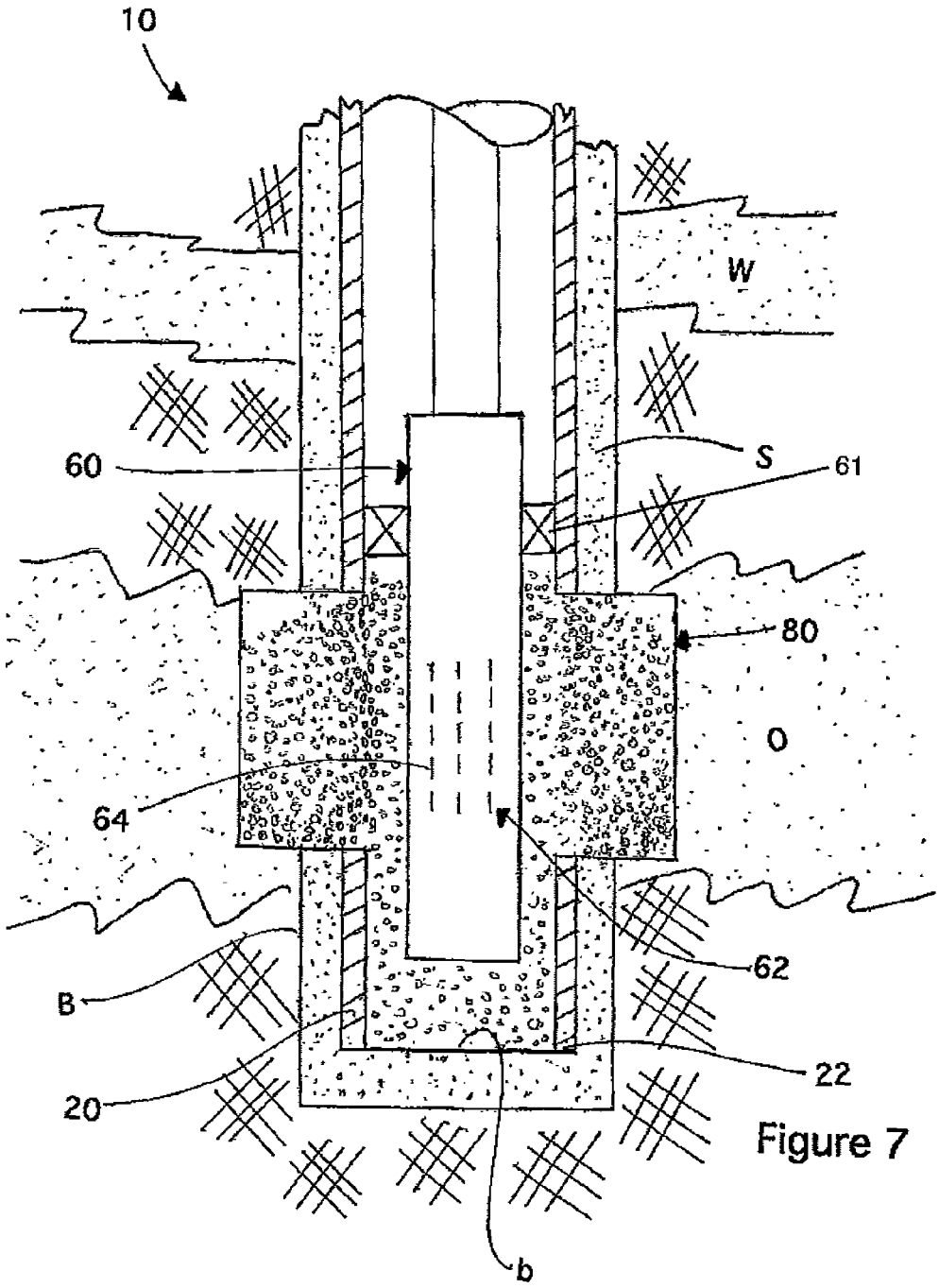
FIG. 7 represents another elevational view of the well's bore shown in the previous figures with a producing tube in place that includes a screen through which the filtered sand with oil is passed.

This permits a user to deliver gravel of the largest possible diameter, if required, without risking undesirable internal obstructions. The fluid also passes through and is collected back through holes 64 of screen 62. The fluid travels back under pressure through returning tube 67, leaving the gravel G in place. Once a sufficient amount of the gravel mix 70 is pumped in the enlarged portion of the well, setting tool 50 is retrieved and producing tube 60 is installed. The result is a considerably larger volume of gravel filter 80 with an extended life, as best seen in FIG. 7.

Producing tube 60 includes a screen 62 with through holes 64 cooperatively smaller than the diameter of the granular material constituting the annular filter to prevent this material from entering producing tube 60. Different types of producing tubes 60 are conventionally used.

One of the advantages of the present method for creating a gravel filter is its precision. A user can control the dimensions of the window or windows to be built in casing 20. The range of the sizes of the gravel is maximized, providing more flexibility to the user. The present methods for building gravel filters involve gunning a portion of casing 20 with unpredictable locations and dimensions for the holes. The use of the present method permits a user to build filters that are more reliable and track the intended specifications.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A method for making gravel filters in oil wells having a casing coaxially mounted within a well bore and defining a space between said bore and said casing that is cemented to keep said casing in place, comprising the steps of:

A) ascertaining a location, at the cemented casing in an oil well bore, adjacent to a producing formation where a gravel filter is to be built;

B) cutting a portion of said casing adjacent to said producing formation;

C) enlarging said bore's diameter where said portion was cut to create an enlarged annular space by removing the cemented space adjacent to said portion and beyond the bore's initial diameter;

D) lowering and installing a producing tube having a distal end with an intake screen and being coaxially disposed within said casing and positioning said intake screen substantially adjacent to said casing portion which was removed;

E) depositing an effective amount of gravel through said enlarged annular space and said gravel being delivered from above said screen at a first predetermined distance from said portion and exteriorly thereof between said screen and said casing, and the largest diameter of said gravel being limited by the separation between said casing and said screen; and F) locating sealing unit in said space between said screen and said casing at a second predetermined distance above said portion and below said first predetermined distance and said sealing unit being set after said gravel is deposited so that said sealing unit seals said annular space between said screen and said casing.

2. The method set forth in claim 1 wherein said step of depositing an effective amount of gravel includes the use of a setting tool with a central tube ending with at least two connected inclined tubes defining respective openings in said setting tool for the delivery of said gravel and fluid.

3. The method set forth in claim 2 wherein said inclined tubes are reinforced to withstand the abrasive action of said gravel and fluid.

4. The method set forth in claim 3 wherein the steps of cutting said casing and enlarging said bore's diameter is performed with a section mill and an underreamer.

5. The method set forth in claim 4 wherein the gravel is selected for predetermined diameters in accordance with the characteristics of said producing formation.

* * * * *